United States Patent [19]

Le Jeune

[11] Patent Number: 4,603,909

[45] Date of Patent: Aug. 5, 1986

[54] DEVICE FOR SEPARATING PHASES FOR RIGID MULTIPHASE MATERIALS

[76] Inventor: Gwénolé Le Jeune, Rue du Vignoble, 44450 St Julien de Concelles, France

[21] Appl. No.: 480,615

[22] Filed: Mar. 30, 1983

[51] Int. Cl.[4] ..... B30B 9/06

[52] U.S. Cl. ..... 299/7; 100/116; 100/127

[58] Field of Search ..... 299/2, 8, 11, 7; 405/271; 100/232, 116, 127; 91/517, 512

[56] References Cited

U.S. PATENT DOCUMENTS

| | | | |
|---|---|---|---|
| 1,922,513 | 8/1933 | Wiedmann | 91/517 |
| 2,495,840 | 1/1950 | Findlater | 299/14 |
| 3,451,185 | 6/1969 | Tezuka | 100/127 |
| 4,107,923 | 8/1978 | Budzich | 91/512 |
| 4,232,600 | 11/1980 | Le Jeune | 100/116 |
| 4,348,943 | 9/1982 | Bougoucos | 91/517 |

FOREIGN PATENT DOCUMENTS

| | | |
|---|---|---|
| 9201 | 9/1908 | France . |
| 477432 | 10/1915 | France . |
| 1271262 | 7/1961 | France . |
| 1421327 | 11/1965 | France . |
| 2302192 | 2/1976 | France . |
| 642123 | 8/1950 | United Kingdom . |
| 998428 | 7/1965 | United Kingdom . |
| 1116849 | 6/1968 | United Kingdom . |

*Primary Examiner*—Stephen J. Novosad
*Assistant Examiner*—Michael A. Goodwin
*Attorney, Agent, or Firm*—Sughrue, Mion, Zinn, Macpeak, and Seas

[57] ABSTRACT

A device for separating the liquid phase from the solid phase of rigid multiphase materials such as bituminous schists, domestic waste and vegetables, in which there is used at least one compression operation at a pressure of at least 500 bars, the compression being effected in at least a first elongated chamber (2) having orifices (4) adapted to let the fluid materials pass, a pressure being applied at an inlet end (1*a*) by a piston (3), the volume of the chamber exceeding the volume swept out by the piston so that the compressed material remains under pressure in the chamber during several strokes of the piston, the other end (1*b*) of the chamber being equipped with an extraction-metering system (5) so as to allow the permanent pressure of the material in the chamber.

10 Claims, 17 Drawing Figures

DEVICE FOR SEPARATING PHASES FOR RIGID MULTIPHASE MATERIALS

Figure 1:
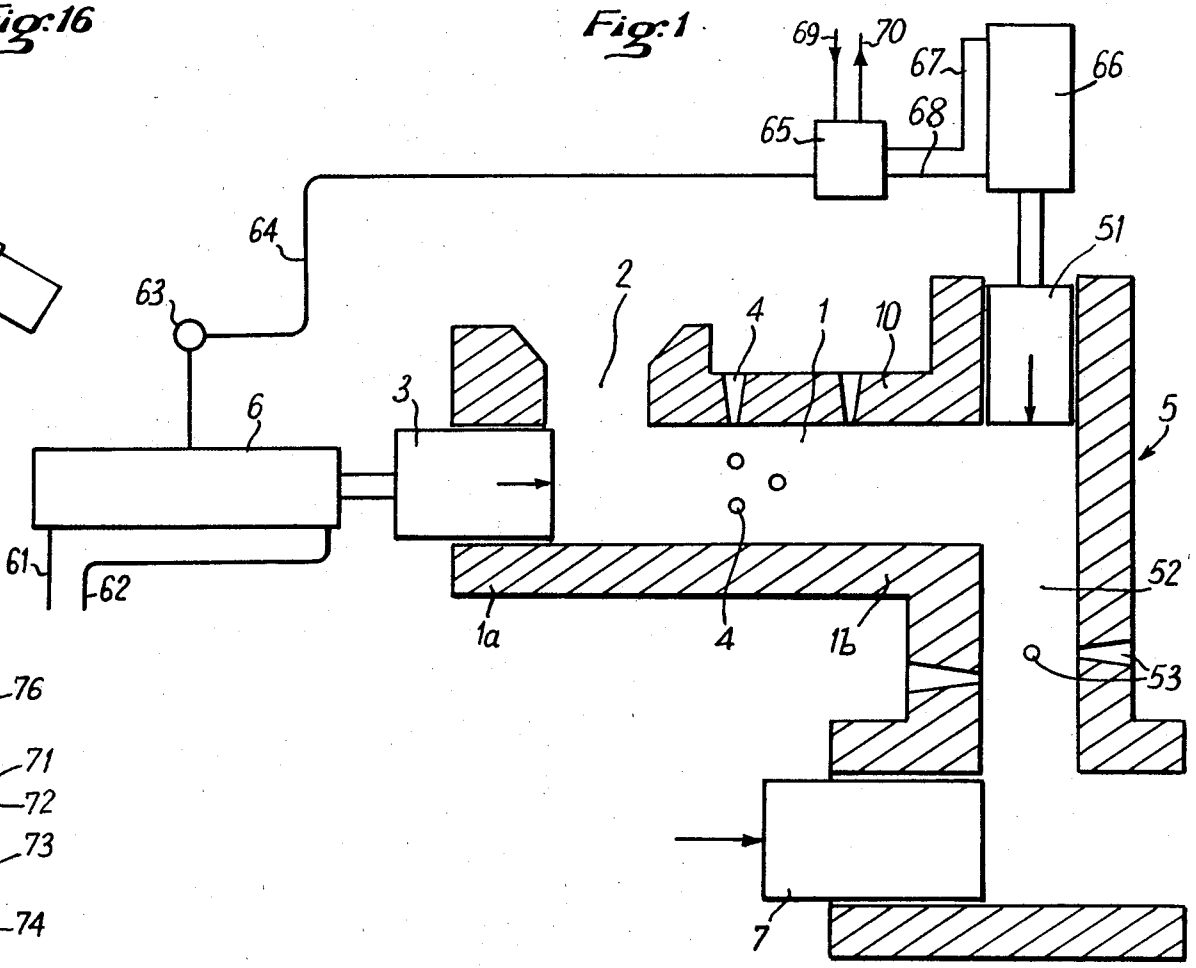

The invention refers to a new method of separating phases of relatively rigid materials comprising a solid phase and a phase which is softer and thus more fluid which it is of benefit to separate directly by means of pressure.

Presses have previously been proposed capable of subjecting materials, especially domestic waste (see, for example, French Pat. No. 2 389 577) to treatment, which use pressures of several hundred bars to cause the softer constituents to flow through orifices of specific sizes, while retaining the solid phase and ejecting it at another point from which it is recovered.

A common feature of these presses is the fact that the pressure adapted to bring about the flow is exerted for only part of the total machine cycle, for approximately ten seconds out of a total duration of twenty seconds, for example.

This rules out high rates of operation, as the flow time is a non-reducible physical magnitude, and the efficient separation of phases of less favourable materials, such as bituminous schists, for example.

The essential objective of the invention consists in spreading the duration of pressurisation, and therefore of flow, over a number of machine cycles. This provides for very high rates of operation while retaining sufficient material flow time for separation of the phases to be complete.

The object of the present invention consists in a method and device for separating the liquid phase from the solid phase of rigid multiphase materials such as bituminous schists, domestic waste and vegetables or similar, noteworthy in particular in that use is made of at least one operation to compress the material at a pressure of at least 500 bars, compression being effected in at least a first longitudinal chamber having orifices adapted to let pass the fluid materials and comprising at an inlet end compression means capable of supplying the necessary pressure, consisting in a piston of the same cross-section as the chamber operated by a hydraulic jack, and at the other end an extraction and metering system conditioned by the pressure in the compression jack, so as to ensure that on average the quantity of material which it allows or causes to leave, augmented by the quantity of fluid materials extracted, is equal to the quantity of unprocessed materials introduced on each cycle. Thus if the pressure in the jack increases excessively, the extraction and metering system will increase the output rate in order to prevent materials backing up in the press body. The volume of the press body is advantageously sufficient to permit the compacted material to remain in the chamber for a time interval substantially greater than one cycle, of the order of five cycles, for example. As the material is compacted, the volume thus provided is not in direct proportion to the volume of non-compacted material introduced on each cycle. The materials are thus exposed to the pressure during a number of cycles, which enables the fluid material to be extracted in the desired proportion.

Other advantages of the invention will emerge when the description is read. In particular, a new application of the invention provides for this technique being used in the field of extraction of hydrocarbons from bituminous schists.

Machines have already been proposed for compressing grapes, oil-bearing vegetables and other similar products in a kind of tube fed at one end by a rammer adapted to exert a certain pressure and equipped at the other end with a variable orifice constriction regulated by the action of springs or counterweights, the tube itself having perforations designed to permit the flow of juices extracted by the pressure [see in particular French Pat. Nos. 477 432 (Bucher-Guyer), 680 054 (Allin) and 1 287 354 (Herbelot) and British Pat. No. 642 123 (Rose et al.)]. These devices are not adapted to the problem to which the present invention is addressed: firstly because the adaptation to very high pressure is not obvious, and also because these devices are designed for treating products which are substantially homogeneous and of regular structure, at least during a relatively long time period.

The object of the method in accordance with the invention is to extract the fluid phase from materials which are significantly more rigid than those previously cited and whose behaviour under pressure differs fundamentally from that of these semi-liquid products.

In particular, it is necessary in accordance with the invention to employ considerable pressure, exceeding 500 bars, as provided by hydraulic jacks so as to obtain the necessary pressure on each movement of the main filler piston. A press of this kind in accordance with the invention is composed of at least three components.

During the first part of its travel, a hydraulically operated piston moves over a lateral orifice through which the materials are introduced. It forces the entrained materials to enter a longitudinal chamber adapted to resist the necessary pressure. This piston introduces successive charges of materials to be compressed.

A device at the outlet from the longitudinal chamber allows the non-fluid material to pass out, the fluid material flowing through orifices formed in the walls of the chamber.

As the stroke of the filler piston is by its very nature limited, it is necessary that the quantity of non-fluid materials which can leave it be substantially and on average equal to the quantity of materials introduced by the filler piston less the quantity of fluid materials extracted through the orifices in the chamber.

If the non-fluid materials are removed too quickly, the filler piston will not encounter sufficient resistance and the separation of phases will not be complete.

If the non-fluid materials are not removed quickly enough, the filler piston will encounter excessive resistance before reaching the end of its stroke, and the cumulative deficit resulting from this limitation leads to the entire device jamming.

In accordance with the invention, the rate of extraction of the non-fluid material is conditioned by the pressure encountered by the filler piston at the end of its stroke.

The necessary stabilising effect is obtained by virtue of the volume of the pressure chamber, which must not be less than five times the volume of materials introduced on each cycle, the volume of the materials referred to here being that in the compacted state. This ratio is proportional to the required material flow time.

Other characteristics of the invention will emerge from the following description given by way of non-limiting example with reference to the accompanying drawings and which will explain how the invention may be carried into effect.

Figure 16:
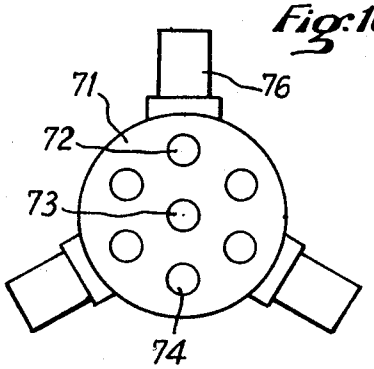
Figure 17:
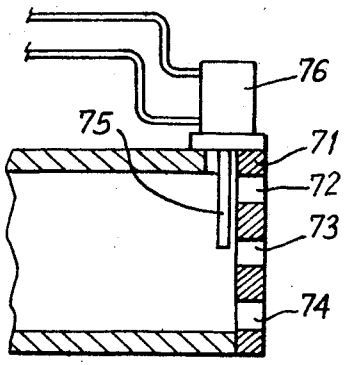
Figure 2:
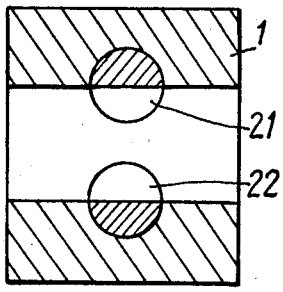
Figure 3:
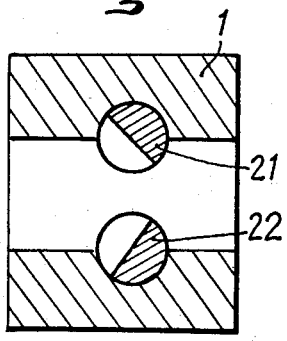
Figure 4:
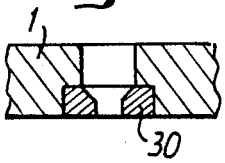
Figure 5:
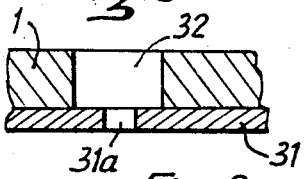
Figure 9:
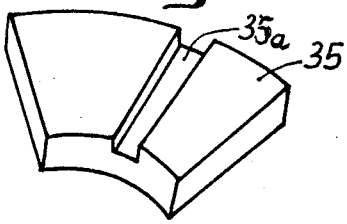
Figure 6:
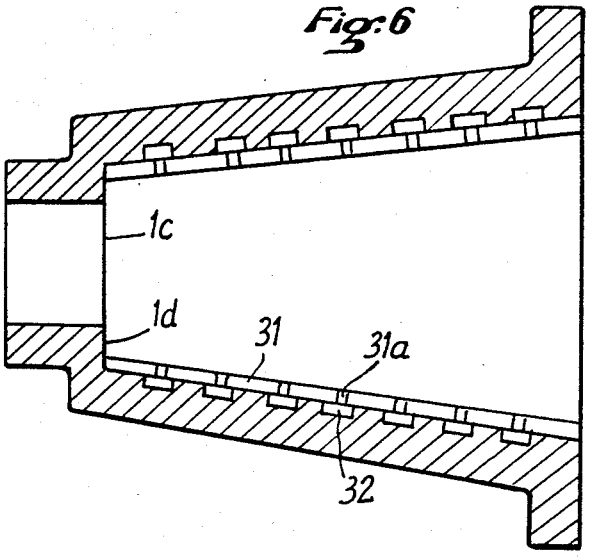
Figure 7:
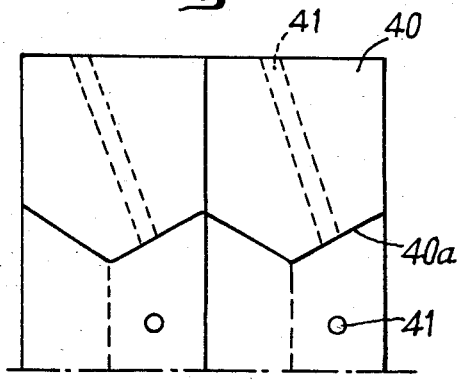
Figure 8:
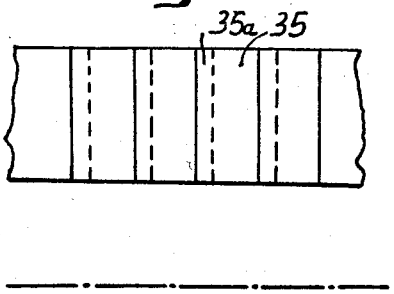
Figure 10:
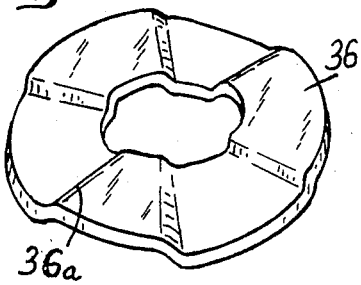
Figure 12:
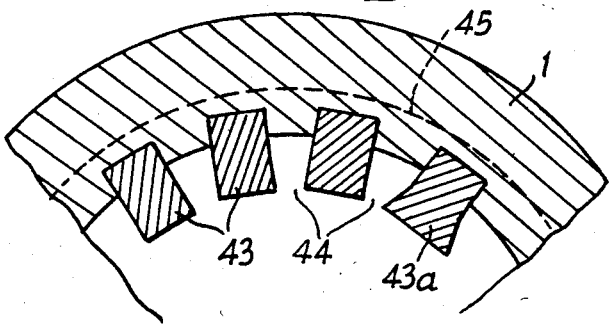
Figure 11:
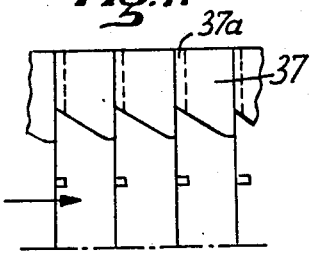
Figure 13:
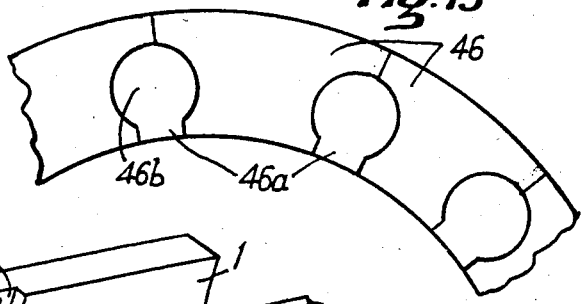
Figure 14:
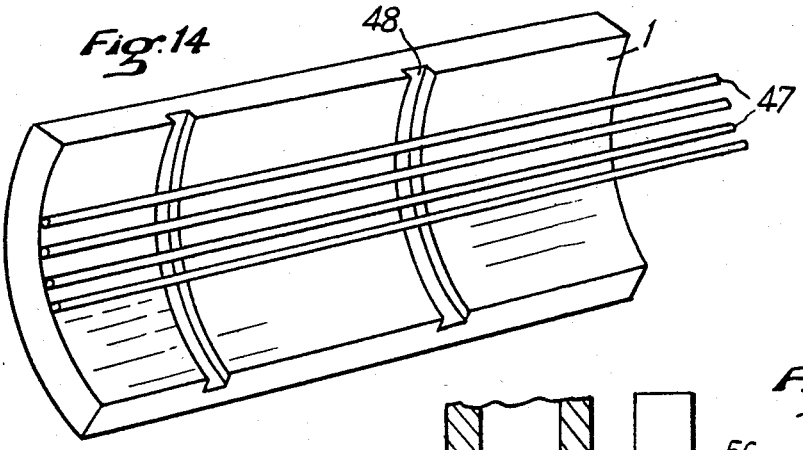
Figure 15:
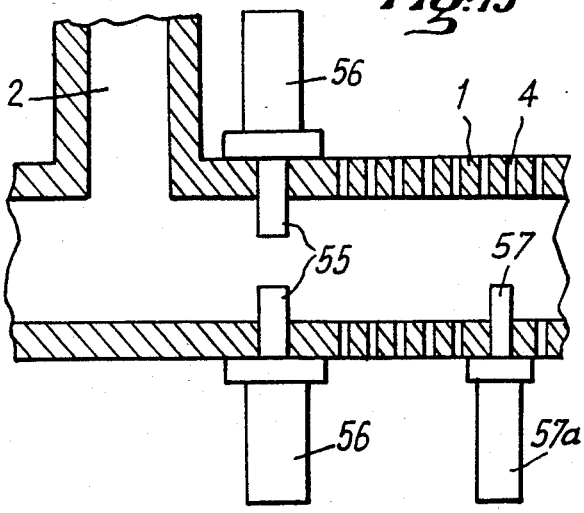

In the drawings:

FIG. 1 is a schematic view in cross-section showing the principle of the present invention in one embodiment, FIGS. 2 and 3 are schematic representations in cross-section on a plane through the axis of the press body of one version of the extraction and metering system, consisting of two cylinders, FIG. 4 represents in cross-section a replaceble perforated plug for lining the holes through which fluid material escapes from the compression chamber, FIG. 5 represents a detail view in cross-section of one form of hole in the wall of the chamber, FIG. 6 represents a general cross-section through another embodiment of the chamber, FIG. 7 is a schematic partial cross-section through another embodiment of the chamber, FIG. 8 is a schematic partial cross-section through a further embodiment of the chamber, FIG. 9 represents in perspective part of a disc constituting the chamber of FIG. 8, FIG. 10 represents in perspective a disc constituting another embodiment of the chamber, FIG. 11 represents in partial axial cross-section another embodiment of the chamber, FIGS. 12 and 13 represent two further embodiments of the chamber in partial cross-section perpendicular to the axis, FIG. 14 represents in perspective part of another embodiment of the chamber, FIG. 15 represents part of a further embodiment of the chamber in axial cross-section, and FIGS. 16 and 17 schematically represent, end-on and in axial cross-section, another embodiment of the extraction and metering system in accordance with the invention.

Generally speaking, the device in accordance with the invention comprises a press body 10 enclosing a chamber 1 with an inlet side 1*a* and an outlet side 1*b*. The press body may be cylindrical, that is to say have a constant cross-section, which may be circular, or of another shape, for example square or rectangular, or divergent from inlet 1*a* towards outlet 1*b*. For preference it is non-convergent. It may happen that the materials introduced at the inlet include an incompressible and undeformble rigid body (an iron bar, for example), and it is necessary that this be able to get out. This condition will always be satisfied if the outlet cross-section is always greater than or equal to the inlet cross-section, more precisely if the inlet cross-section may be inscribed on or within the outlet cross-section. However, this condition may be dispensed with if the material to be treated is first sorted or screened. This may be of advantage in certain applications. On the inlet side is a lateral opening 2 for admitting materials to be treated and a compression piston 3 operated by a hydraulic jack 6 supplied through conduits 61 and 62. The press body comprises orifices 4 to permit fluid materials to escape. These orifices will be described in more detail hereinafter. On outlet side 1*b* is an extraction and metering system 5, the output rate of which is conditioned by the resistance encountered by piston 3, in other words, in practice, by the pressure in the jack operating piston 3. A pressure gauge 63 measures the pressure of the fluid in jack 6 and a line 64 connects pressure gauge 63 to a control system 65 for the extraction and metering system.

In a preferred embodiment of the invention (FIG. 1), the non-fluid material extraction and metering system at the outlet end 1*b* of the pressure chamber consists in a second piston 51 preferably transverse to the axis of the chamber.

Capable of shearing off and expelling materials at the outlet from chamber 10, piston 51 may obstruct the outlet from the chamber when it is in the unoperated position and then, on command from the control system, move back to expose the outlet and then advance again to the unoperated position after shearing off and thrusting before it the quentity of materials leaving the chamber during the retraction time under the effect of the pressure. It would be possible to condition movement of this piston 51 by the pressure encountered by feed piston 3 at the end of its stroke so as to subject the materials to appropriate and substantially constant pressure.

Piston 51 may be operated by a jack 66 fed by two conduits 67, 68 passing through control unit 65, itself connected to a pressurised fluid conduit 69 and a return 70 to the sump, unit 65 being controlled by line 64 connected to pressure gauge 63 registering the pressure in cylinder 6 in which compression piston 3 acts. Provided that the pressure in 63 does not reach a predetermined value, the control unit maintains the chamber closed, or partially closed (possibly by virtue of the presence of compacted materials as indicated hereinabove). If the pressure in 63 exceeds a set point value, the jack operates to disengage the chamber outlet. Unit 65 may be a hydraulic system or comprise appropriate electronics.

System 65 may, for example, be a monostable type four-way valve connecting lines 69 and 70 to line 67 and 68 in one case or 68 and 67 in the other. If the pressure P at the end of the stroke of jack 6 is less than a predetermined value Po, the piston 5 remains advanced and obstructs the end of chamber 1, line 69 being connected to line 67. If P exceeds Po, the monostable valve changes position and line 69 is connected to line 68 while line 67 is connected to line 70 (sump). The piston 51 moves back and exposes the end of the chamber and pressure P drops below Po. The piston decends again, driving out a volume of compacted material.

As an alternative, and for certain more rigid materials, the unoperated position of piston 51 is the retracted position, the compacted non-fluid materials being incapable of leaving through the right-angle section which the end of the chamber thus constitutes. Such extraction, and consequentially its metering, can only be obtained after a command from the control system to advance the transverse ejector piston 51.

Another method in accordance with the invention for metering the output of non-fluid materials consists in a variable constriction in the cross-section of the outlet from the pressure chamber, this cross-section being conditioned by the pressure encountered by the filler piston at the end of its stroke, the opening decreasing on each cycle as the necessary pressure is achieved more quickly.

A preferred means in accordance with the invention of achieving this variable constriction consists in one or two cylinders 21, 22 (FIGS. 2 and 3). These rotary cylinders are preferably a variety of metal cylinder with their axes substantially perpendicular to the outlet section of the chamber, itself generally cylindrical. Each cylinder is formed with a cavity such that variation in the angular position of the cylinder brings about variation in the outlet cross-section for the non-fluid materials.

For the relatively rigid materials to which the invention applies, it is never necessary to completely obstruct the outlet section.

Given these conditions, and allowing for the considerable forces exerted on the cylinders, it is preferable to move them as far apart as possible so that their non-active ends may be supported in sufficiently strong bearings, thus ruling out in particular the use of tangential cylinders providing for complete shut-off.

On the other hand, the processing of these rigid materials, especially if they are not homogeneous, as is the case with domestic waste, may result in the introduction into the chamber of non-deformable materials which may be cut off by the advancing filler piston.

In accordance with the invention, and so as to permit the extraction of materials, the outlet cross-section in the wide open position is at least equal to the inlet cross-section in order to avoid irreversible jamming (FIG. 2). A control system similar to that in FIG. 1 controls the position of the cylinders according to the pressure in jack 6, using the same principle.

The system could operate at two pressures: if the pressure in the jack exceeds a maximum pressure, the cylinders move to the maximum open position, whereas below a minimum pressure the cylinders move to the minimum open position.

Repeated compression of the materials in the chamber by the filler piston gives rise to preferential cleavage planes substantially perpendicular to the introduction direction. This specific structure may not be favourable to the radial movement of fluid constituents under the action of the pressure gradient between the interior of the materials and the orifices in the envelope.

Thus in one method of applying the invention, the first chamber 10 is followed by a second chamber 52 whose axis is substantially perpendicular to the outlet from the first chamber, which discharges directly into the inlet of the second chamber. The second chamber also comprises fluid material exit holes 53.

Given these conditions, the extraction and metering system of the first chamber will advantageously constitute the filling system of the second chamber (FIG. 1). A piston 7 disposed in a bore perpendicular to the second chamber 5 may serve as an extractor in shearing off the product once more. Extraction may still be obtained by piston 51, along the axis of the second chamber 5.

Where there are at least two compression stages, it is advantageous to operate them at different pressures.

In the case of domestic waste, for example, compression in a single stage requires a delicate compromise between the pressure exerted and the size of the orifices. Excessively small orifices require the use of high pressures and are susceptible to wear and clogging. Excessively large orifices allow unwanted hard constituents to pass, unless the pressure is significantly reduced, which comprimises complete separation of phases.

In accordance with the invention, the first stage preferably operates at reduced pressure, of less than 500 bars, for example, in the case of domestic waste 300 bars being a good value.

This reduced pressure permits the use of large orifices, of 10 to 15 mm in this example, providing for a high rate of output without the low pressure used resulting in the discharge of unwanted materials.

The second stage receives at its inlet materials which have already been dehydrated and compacted by the first pressure. Application of a high pressure, of 800 to 1,000 bars in the case of domestic waste, for example, permits highly efficient separation of phases while the initial cohesion of the pre-compacted materials prevents the discharge of unwanted hard constituents. The relatively small quantity of materials to be extracted in the second stage permits the use of small orifices, of less than 10 mm in practice.

In view of the application of considerable pressure to matters which are generally highly abrasive (domestic waste, rock, . . . ), the materials in contact with these matters are subject to intense abrasion, in particular the orifices through which the fluid materials flow at high speed. The parts comprising these orifices must be replaced frequently. It must be possible to effect such replacement rapidly and the materials replaced must be as economic as possible.

In accordance with the invention, these orifices consist in removable perforated plugs 30 (FIG. 4) fixed in the wall of the chamber and made of a hard material such as tungsten carbide, for example, with calibrated and conical holes in them which diverge in the direction of flow and finally discharge to the exterior (into the collection chamber) without further construction in the path of the materials.

In another embodiment of the invention, the chamber is internally lined with a perforated lining 31 (FIG. 5) of hard sheet metal designed to be changed quickly and economically when worn out.

Orifices 31*a* discharge into other orifices 32 formed in the wall of chamber 1 and of slightly greater diameter than the orifices in the lining, or into drainage grooves which may be circular or helical, for example.

For attaching the lining so as to be readily replaceable, the chamber is bored out with a slight diverging taper (FIG. 6) in the direction of displacement of materials. The lining, which has the same taper, is inserted and removed through the larger end, either by virtue of displacement of the nozzles supporting the extraction and metering system, or preferably through the wide open nozzle, the lining being in this case attached by other means such as nuts, transverse pins, or retaining washers, Another device in accordance with the invention provides for forming readily replaceable orifices in the walls of the chamber. The chamber itself is constituted by stacked discs 40 pierced by a bore 41 (FIG. 7), this bore constituting the internal wall of the chamber.

In view of the magnitude of the axial forces exerted on the discs by the materials, it is preferable for these discs to bear directly on one another.

It is, however, possible to partially hollow out the bearing surfaces of discs 35 by means of grooves 35*a* (FIGS. 8 and 9), preferably diverging from the inside towards the outside, so as to form orifices for the passage of the fluid materials.

As an alternative, discs 36 may be obtained by cutting and stamping relatively thick sheet metal, a certain degree of corrugation 36*a* in their profile (FIG. 10) resulting in alternating projecting and set back sectors also forming the necessary orifices. The discs must naturally be disposed so as to avoid complete nesting, which would not leave any outlet channel.

When treating non-homogeneous materials such as domestic waste, there is always the risk of bulky and unusually hard constituents being present and, entrained by the general advance of the products in the chamber, exerting destructive local pressure on the walls of the chamber, in particular at the orifices on which such hard constituents might find a purchase.

To avoid these destructive effects, it is preferable in accordance with the invention for the bore in discs 37 (FIG. 11) to have a tapering profile which converges in the direction of displacement of the materials so that the latter cannot snag on them. In this case, orifices 37*a* will be formed in the sheltered area on the downstream side of the maximum constriction. This area of relatively low pressure, partially sheltered from the direct radial pressure of the materials, is also the most propitious for correct propagation of the fluid materials with minimum risk of the orifices clogging.

As previously described, to this same end the stamped discs could with advantage have their internal bore of curved profile.

As an alternative discs 40 could be bored with tapers intially convergent and then divergent (FIG. 7). In this case, drain orifices 41 would be placed on the divergent slope 40*a*, which is not likely to be snagged and also at relatively lower pressure.

When the materials are particularly hard and of low malleability, such as certain rocks containing hydrocarbons, and in view of the pressures employed, in this case very high, protection of the orifices by the use of tapered profiles is no longer sufficient. The internal longitudinal profile of the chamber must in this case be as smooth as possible and continuous.

For this reason in particular, and in accordance with the invention, use is made of orifices in the form of continuous longitudinal slots formed along generatrices of the chamber. In this case, use will preferably be made of longitudinal rods 43 (FIG. 12) of a wear-resistant material defining between them grooves 44 connected to collectors 45. By way of example, one rod 43*a* is shown with a wider base. It may be obtained by drawing, forging or surfacing by welding.

In a particularly strong embodiment rods 46 are juxtaposed and contiguous so as to bear on one another and also against the strong wall of the chamber (FIG. 13), in the direction of the pressure.

The selected profile shown by way of non-limiting example in FIG. 13 is such that, when urged tightly against one another, rods 46 delimit between them grooves 46*a* providing passages for the fluid materials and opening into a cavity 46*b* of larger dimensions not likely to be clogged by the largest contituents previously having passed through these grooves.

Finally, the ends of these channels discharge, for example, into a chamber from which the extracted materials are collected.

In certain cases, in the presence of non-homogeneous materials, such as domestic waste, certain constituents which may enter the grooves can cause stresses on the edges of the latter which may lead to them breaking.

One solution in accordance with the invention consists in the use of rods 47 (FIG. 14) which are not contiguous, which are attached only at the inlet end and which rest freely on the walls of the chamber. Given these conditions, a localised abnormal load merely causes lateral displacement of the rod, which returns to its initial position once the disturbing effect has disappeared. By virtue of the relative mobility of the rods, this arrangement favours unclogging of the grooves formed between them.

A beneficial arrangement in accordance with the invention consists in forming at regular intervals in wall 1 of the chamber on which the rods bear circular or helical grooves 48 adapted to drain off the fluid materials and finally discharging externally of the chamber.

A particularly economical arrangement in accordance with the invention consists in the use of cylindrical rods of circular cross-section. These rods are attached, preferably at the inlet end of the chamber, by means of an interference fit system based on one or more tapers and counter tapers so as to simultaneously ensure the required spacing between rods, their locking in position and their quick removal. As an alternative, the rods may be screwed or force-fitted into bores formed in the front surface 1*c* at the inlet end of the chamber, around the piston.

When certain materials to be treated are introduced into and compacted within the chamber, they tend to expand elastically when the filler piston moves back for its next cycle. This phenomenon varies according to the nature of the materials to be treated and compromises the maintaining of adequate pressure in the chamber and thus the effectiveness of the flow.

Thus, in accordance with the invention, a system may be provided for retaining the charge introduced, in the vicinity of the inlet, and capable of preventing rearward movement of the compacted materials.

In view of the rigidity and cohesion of the materials which have just been compacted, it is not necessary to provide a system for completely shutting off the passage.

Preferred means in accordance with the invention (FIG. 15) consists in forcing one or more cylindrical bars 55 of any section to penetrate into the compacted mass, either before or during the backward movement of the filler piston. These retaining bars are operated by hydraulic jacks 56 and designed so that they do not project into the chamber in the retracted position or let significant quantities of materials pass through the apertures in the wall of the chamber necessary for their displacement.

As an alternative, use is made of one or more rotary cylinders 21, 22 of the same type and characteristics as those provided at the outlet from the chamber.

In certain cases, rapid enlargement of the chamber cross-section relative to the filling cross-section is an efficient arrangement, especially if the materials are particularly cohesive after compacting.

In one embodiment of the invention, the retaining system is implemented by virtue of compression piston 3 having a diameter which is slightly less than that of radial wall 1*c* at the inlet end of the chamber (see FIG. 6). Compacted materials having a certain degree of cohesiveness bear on annular surface 1*d* of wall 1*c* and resist rearward movement by virtue of a buttressing effect against this annular surface.

As previously indicated, the compacting of materials at very high pressure causes the softer constituents to flow towards the orifices formed in the walls of the chamber. The fluid materials in fact flow along the pressure gradient existing between the interior of the mass of compacted materials and the edges.

In accordance with the invention, the gradient may be considerably increased and the extraction of fluid materials facilitated by the forced penetration of bars 57, preferably cylindrical, into the mass of pressurised materials. Like the retaining bars, these bars do not project into the chamber in the retracted position, so as to avoid disturbing the movement of materials within the chamber. Bars 57 are advantageously operated by jacks 57*a*.

It is preferable to use these bars in conjunction with the retaining bars at the inlet. The penetration of the cylindrical bars, substantially perpendicular to the walls of the chamber, causes a certain degree of splitting, in addition to a significant grinding effect.

In certain cases, penetration of the bars assists in facilitating the passage of the materials to the outlet, which might have been difficult or even impossible in view of the high pressures employed, generating significant friction forces against the walls. In this case, a number of bars are preferably used, introduced successively in the displacement direction.

In accordance with the invention, continuous or discontinuous annular clearance is provided between the bars and the walls of the orifices formed in the chamber to allow the bars to pass. This space advantageously provides an orifice allowing the fluid materials to pass, the sliding movement of the bars having a continuous unclogging action.

After passing through the wall of the chamber, the fluid materials are collected in a chamber on the downstream side.

Another embodiment of the extractor device is shown in FIGS. 16 and 17. The end of the chamber is formed by a wall 71 comprising a number of holes (seven in the example shown) 72, 73, 74 by virtue of which the dry residue is produced in the form of "sausages" of limited diameter, 2 to 7 cm approximately, for example. This embodiment of the invention is only feasible if the material treated has previously been freed of bulky and rigid constituents. Control may be applied by closing off certain holes 72 by members 75 operated by jacks 76. The number of holes closed off is determined so as to obtain adequate pressure within the chamber. Such a device in fact constitutes a drawing or pelletising press with a preliminary dehydration stage.

In a particularly interesting application of the invention, the device is especially designed for application to the extraction of hydrocarbons from bituminous schists, oil-bearing sands and other rocks containing a liquid or semi-liquid phase it is beneficial to recover.

In accordance with the invention, the rocks may be preheated before compacting, so as to facilitate the flow of the hydrocarbons they include.

According to the hardness of the rock, it is necessary to apply very high pressures while allowing sufficient flow time for sufficient extraction. Presses in accordance with the present invention are particularly suited to this problem and able to sustain rates of working compatible with the requirements of this sector of activity. In this application, pressures between 1,000 and 10,000 bars are employed, according to the hardness of the rock to be treated.

One of the major problems in extracting hydrocarbons from bituminous schists by thermal or centrifugal means is the necessity of handling mined rock in transit to centralised treatment installations.

After treatment, the rock is dumped on the surface in enormous piles, whereas the cavities left by mining compromise the mechanical strength of the ground and prevent complete exploitation of seams, except in the case of opencast mining.

The method in accordance with the invention consists in extracting the hydrocarbons by pressing, preferably underground in mining tunnels, under the following conditions.

The drilling machine at the head of the tunnel is immediately followed by one or more mobile presses treating the ore as it is extracted. The hydrocarbons extracted are immediately returned to the surface, preferably by pipelines in technical tunnels connecting to the drilling tunnels.

According to the invention, the compacted rock (which is of smaller volume than the initial volume of the untreated materials by virtue of the process employed) is immediately deposited in the tunnel behind the machines, at least partially blocking off the tunnel again.

Handling is thus minimised, the surface site is no longer congested by mountains of treated materials and, lastly, the closed tunnels are no longer prejudicial to the stability of the soil.

With a view to increasing the mechanical strength of the compacted materials used to close off the tunnels, it is preferable for the stage in which the materials leave the press to be of rectangular cross-section, so as to discharge the compacted material in the form of substantially parallelepipedal ingots on which sufficient mechanical cohesiveness has been conferred by the pressure stresses exerted, depending on the rock treated.

The resulting shape of the treated materials enables them to be rationally "stored" in the tunnel which has just been drilled, making best use of the volume (no increase of volume) and conferring on the stacked ingots excellent mechanical resistance to compression.

In another application, these parallelepipedal ingots may be utilised to construct embankments, barrages and even buildings, in the manner of unfired compacted clay bricks.

It goes without saying that the embodiments described are merely examples and that they may be modified, in particular by the substitution of equivalent technical means, without thereby departing from the scope of the invention.

I claim:

1. A device for separating the liquid phase form the solid phase of rigid multiphase materials such as bituminous schists, domestic waste and vegetables, said device comprising a cylindrical longitudinal chamber (1) having orifices (4) in its cylindrical wall, said chamber having an inlet end (1*a*) and an outlet end (1*b*), the inlet end having a lateral loading opening (2), a first axial compression piston (3) mounted within said cylindrical longitudinal chamber (1) at said inlet end and being operated by a hydraulic jack (6), the volume of the chamber being substantially greater than the stroke volume of the first axial compression piston (3) to permit the compacted material to remain in the chamber for a time interval substantially greater than one cycle; whereby, the material therein are exposed to compression pressure during a number of cycles which enables the fluid material to be extracted in the desired proportion, and the outlet end being open and equipped with an extrcation and metering system (5) responsive to the pressure in the hydraulic jack (6) operating said first axial compression piston (3) so as to maintain a minimum pressure in the chamber even during the return stroke of the first axial compression piston 3.

2. A device according to claim 1, wherein the orifices consist of removable perforated plugs (3) of hard materials, divergently tapered outwardly of said chamber and opening to a collecting chamber for fluid materials without further restriction.

3. A device according to claim 1, wherein a tapered perforated lining (31) of thin sheet metal placed within the longitudinal chamber, said longitudinal chamber is tapered to the same degree as the tapered perforated lining (31), and wherein said tapered perforated lining (31) is comprised of perforations (31a) opening into grooves (32) within the chamber wall, and the taper of said perforated lining and that of said longitudinal chamber being divergent in the direction of movement of the materials therethrough.

4. A device according to claim 1, and wherein said longitudinal chamber is constituted, at least in part, by stacked discs (35, 36, 37) including a cut and stamped profiles so as to bear on with each other with necessary resistance to deformation but leaving pasages for fluid materials between them, said passages constituting said orifices.

5. A device according to claim 4, wherein said discs have walls, and the orifices consist of divergent grooves (35a) within the walls of the discs (35), said grooves (35a) opening to the longitudinal chamber.

6. a device according to claim 1, said device further comprising longitudinal rods (43, 46, 47) lining the interior of said chamber and bearing on said chamber wall and being circumferentially spaced to define a clearance between said longitudinal rods through which pass the fluid materials finally drained to the exterior through said orifices.

7. A device according to claim 1, said device further comprising means (55, 56) for retaining materials introduced into said chamber when said compression piston (3) is retracted within said inlet end of said chamber.

8. A device according to claim 7, wherein said retaining means comprises at least one cylindrical bar (55), and a hydraulic jack (56) for actuating said at least one cylindrical bar and for displacing said cylindrical bar into the chamber in the vicinity of the inlet and in a direction substantially perpendicular to the direction of introduction of said materials into said chamber.

9. A device according to claim 1, said device further comprising at least one cylindrical bar (57) selectively projected into and removed from said chamber substantially perpendicularly to the flow of materials, and a hydraulic jack (57*a*) coupled to said cylindrical bar 57 for effecting that action.

10. A device for separating the liquid phase from the solid phase of rigid multiphase materials such as bituminous schists, domestic waste and vegetables, said device comprising a cylindrical longitudinal chamber having orifices (4) in its cylindrical wall, said chamber having an inlet end (1*a*) and an outlet end (1*b*), the inlet end having a lateral loading opening (92), a first axial compression piston (3) mounted within said cylindrical longitudinal chamber (1) at said inlet end and being operated by a hydraulic jack (6), the volume of the chamber being substantially greater than the stroke volume of the first axial compression piston (3), and the outlet end being open and equipped with an extraction and metering system (5) conditioned by the pressure in the hydraulic jack (6) operating said first axial compression piston (3) so as to maintain a minimum pressure in the chamber even during the return stroke of the first axial compression piston (3), and wherein said extraction and metering system further comprise at least one non-tangential rotary cylinder (21, 22) within said first longitudinal chamber (1), mounted for rotation about its axis for selectively imposing in one position unrestricted passage of the materials through the outlet end and in another position a partial obstruction of the chamber to vary the maximum cross-section of the outlet end of said chamber (1).

* * * * *